US006011363A

United States Patent [19]

Allison

[11] Patent Number: 6,011,363

[45] Date of Patent: Jan. 4, 2000

[54] CONSTANT WATTAGE ELECTRIC BALLAST CIRCUIT FOR LAMP

[75] Inventor: Joseph Michael Allison, Euclid, Ohio

[73] Assignee: General Electric Company, Schenectady, N.Y.

[21] Appl. No.: 09/017,251

[22] Filed: Feb. 2, 1998

[51] Int. Cl.[7] ..... H05B 37/02

[52] U.S. Cl. ..... 315/307; 315/224; 315/308

[58] Field of Search ..... 315/307, 308, 315/224, 310, 311, 246, 268

[56] References Cited

U.S. PATENT DOCUMENTS 5,371,440 12/1994 Liu et al. ..... 315/209 R

OTHER PUBLICATIONS

Graeme et al., "Operational Amplifiers: Design and Applications," McGraw Hill Book Company: New York (1971), pp. 251–258 and title and copyright pages.

*Primary Examiner*—David H. Vu

[57] ABSTRACT

A constant wattage electronic ballast circuit for lamp comprises a circuit for producing a voltage feedback signal substantially proportional to voltage of the lamp. A diode function generator processes the voltage feedback signal so as to produce a processed signal which, within sequential bands of lamp voltage, varies less for a specified variation of lamp voltage in a higher voltage band than in a lower voltage band. A circuit produces a current feedback signal substantially proportional to current in the lamp. A circuit for controlling lamp current comprises a circuit for summing the processed signal with the current feedback signal to create a summed signal, and a circuit for adjusting lamp current in response to the difference between the summed signal and a reference signal.

15 Claims, 4 Drawing Sheets

CONSTANT WATTAGE ELECTRIC BALLAST CIRCUIT FOR LAMP

FIELD OF THE INVENTION

The present invention relates to a constant wattage ballast circuit for a gas discharge lamp, and, more particularly, to such a ballast without the need for circuit trimming during production.

BACKGROUND OF THE INVENTION

An electronic ballast intended to operate high pressure arc lamps of the metal halide variety preferably comprises an automatic control system designed to maintain constant arc watts over a range of primary supply voltages and arc operating voltages. One prior art approach is to use a multiplier as part of the constant watts control system. In such case, arc voltage and arc current feedback signals are suitably scaled and multiplied together. The multiplier output is then subtracted from a reference signal. The difference signal resulting from this subtraction is averaged, amplified and applied to a power controller that adjusts the arc current. The automatic control system then regulates the product of arc volts and arc amperes (arc watts) resulting in an ideal (i.e., constant) arc watts-versus-arc volts characteristic.

However, multipliers are preferably not utilized to combine the voltage and current feedback signals in an electronic ballast. Instead, in another prior art approach, the (suitably scaled) signals are preferably simply summed together, that sum being held constant by an automatic control system. This is because the summing technique yields more constant watts, usually without trimming, and with lower cost than use of a multiplier over a typical arc operating voltage range. Trimming means manual adjustment of circuit values in production, entailing the use of expensive, skilled labor.

The prior art summing technique, however, may require trimming if the operating arc voltage range is wider than usual in combination with a narrow watts specification. It, therefore, would be desirable to provide a constant arc wattage ballast for a lamp that eliminates the need for circuit trimming.

SUMMARY OF THE INVENTION

In an exemplary embodiment of the invention, a constant wattage electronic ballast circuit for a lamp is provided. It comprises a circuit for producing a voltage feedback signal substantially proportional to voltage of the lamp. A diode function generator processes the voltage feedback signal so as to produce a processed signal which, within sequential bands of lamp voltage, varies less for a specified variation of lamp voltage in a higher voltage band than in a lower voltage band. A circuit produces a current feedback signal substantially proportional to current in the lamp. A circuit for controlling lamp current comprises a circuit for summing the processed signal with the current feedback signal to create a summed signal, and a circuit for adjusting lamp current in response to the difference between the summed signal and a reference signal.

The foregoing ballast eliminates the need for circuit trimming. This reduces the cost of the ballast, while increasing its reliability.

DETAILED DESCRIPTION OF THE INVENTION

Figure 1:
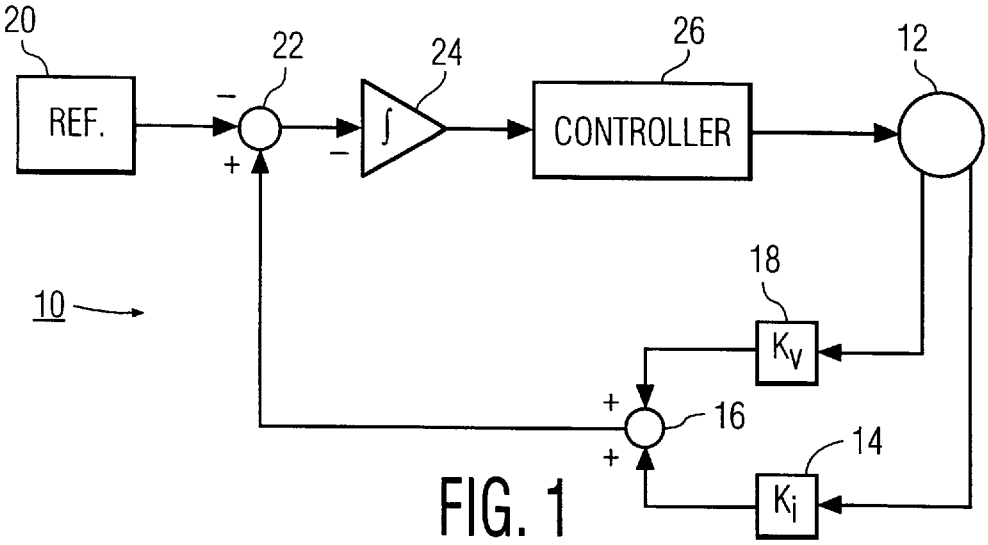
FIG. 1 PRIOR ART
FIG. 1 is a block diagram of a prior art circuit for achieving nearly constant arc wattage under some conditions.
Figure 2A:
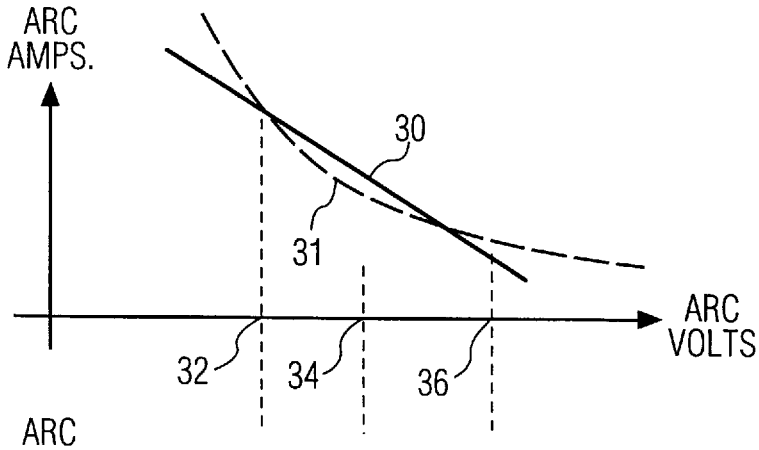
FIG. 2A PRIOR ART
FIGS. 2A and 2B respectively show an arc amps-versus-arc volts characteristic, and arc watts-versus-arc volts characteristic for the prior art circuit of FIG. 1.

In order to more fully describe the invention, the prior art summing technique mentioned above is first considered in connection with FIGS. 1 and 2. FIG. 1 shows a prior art system 10 for controlling current of a lamp 12. Current feedback from the lamp is scaled by a scaling factor Ki in a circuit 14 before being passed to a summing circuit 16. Voltage feedback from the lamp is similarly scaled by a scaling factor Kv in a circuit 18 before being passed to summing circuit 16. A signal representing the difference between the summed signal from circuit 16 and a reference voltage from circuit 20 is produced by a summing circuit 22, fed through an error-integrating amplifier 24, and passed to a controller 26, which responsively sets the value of lamp current.

Accordingly, in the prior art technique, the (suitably scaled) signals are simply summed together, that sum being held constant by the automatic control system 10. Attributable to the constant sum, increasing arc volts automatically results in linearly decreasing arc amperes which, in turn, results in quasi-constant arc watts. If arc amperes is plotted versus arc volts, the characteristic is a straight line 30 (FIG. 2A) with negative slope instead of the hyperbola (1/x) function, shown at 31, that would result if the feedback signals were truly multiplied together. Respective minimum, mean and maximum arc operating voltages 32, 34 and 36 are shown on the volts axis for FIGS. 2A and 2B. The arc watts-versus-arc volts characteristic is a parabola 38 (FIG. 2B) opening downward instead of the constant characteristic 37 that would result from the use of a multiplier.

Figure 2B:
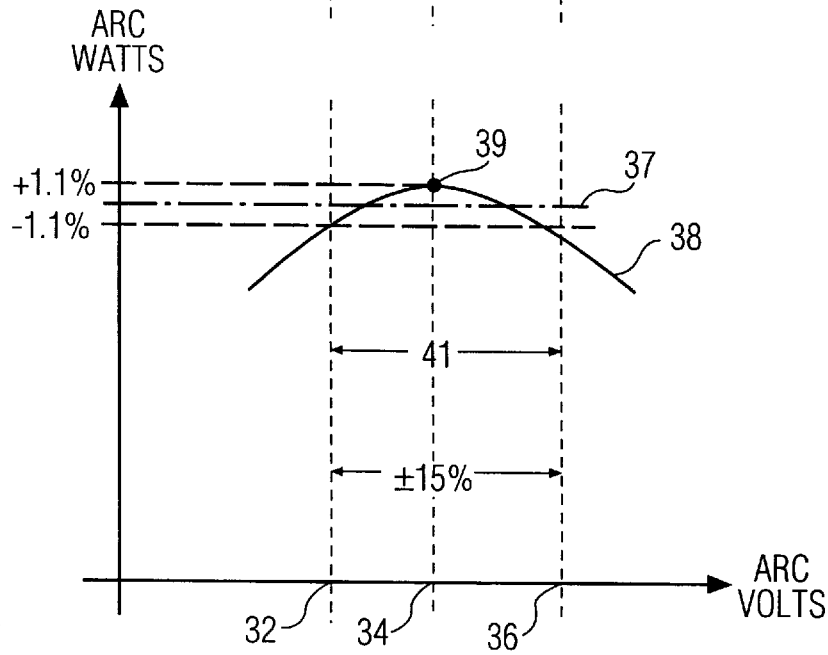
FIG. 2B PRIOR ART

The scaling constants and reference voltage of the circuit of FIG. 1 are optimized for minimum watts variance as follows. The vertex 39 of the parabola is located horizontally at the arithmetic mean (or center) 34 of the arc operating voltage range 41 and vertically such that the watt variances (e.g., [±]1.1%) above and below nominal watts are equal (in their absolute values) and are minimum. The parabola 38 is almost flat in the region of the vertex and approximates the desired constant watts characteristic quite well for narrow voltage ranges. Typically, the operating arc voltage range width is less than (±) 15% with a corresponding watts variance, due to the curvature of the parabola, of less than (±) 1.1% as shown in FIG. 2B. The superior value of the summing technique (compared to the use of a multiplier) is verified by the following consideration. A multiplier has an internal gain constant with an untrimmed tolerance typically much greater than the error caused by the parabola curvature. A summer, on the other hand, has zero internal error: a summer consists of nothing more than a node connecting two scaling resistors corresponding with resistors that are needed anyway in the external circuitry of a multiplier. The summing technique yields better watts accuracy, without trimming, with lower cost than does a multiplier over a typical arc operating voltage range. Use of the summing technique usually avoids the need for production trimming. However, if the operating arc voltage range is wider than usual in combination with a narrow watts specification, the summing technique may fall short as the following example shows. First, examine the following table listing the optimized watts variance due to the parabola curvature for several arc voltage range widths.

TABLE I

Effect of Parabola Curvature

| (+/−) % volts range | (+/−) % watts variance due to parabola curvature |
|---|---|
| 5% | 0.1% |
| 10% | 0.5% |
| 15% | 1.1% |
| 20% | 2.0% |
| 25% | 3.2% |
| 30% | 4.7% |

Table I was prepared from the following mathematical formula, derived by the present inventor.

$$Kw=Kv^2/(2-Kv^2) \quad \text{(eq. 1)}$$

where:

Kw=decimal value of (±) % watts variance due to parabola curvature; and

Kv=decimal value of (±) % volts range.

Assume the specified voltage range width is (±) 30% and the watts must be maintained within a specified (±) 5%. The watts variance due to the parabola curvature alone is (±) 4.7% (Table I), consuming almost all of the variance permitted, leaving practically no leeway for circuit tolerances. A prior art solution would be to trim each circuit in production, but is costly.

Figure 3:
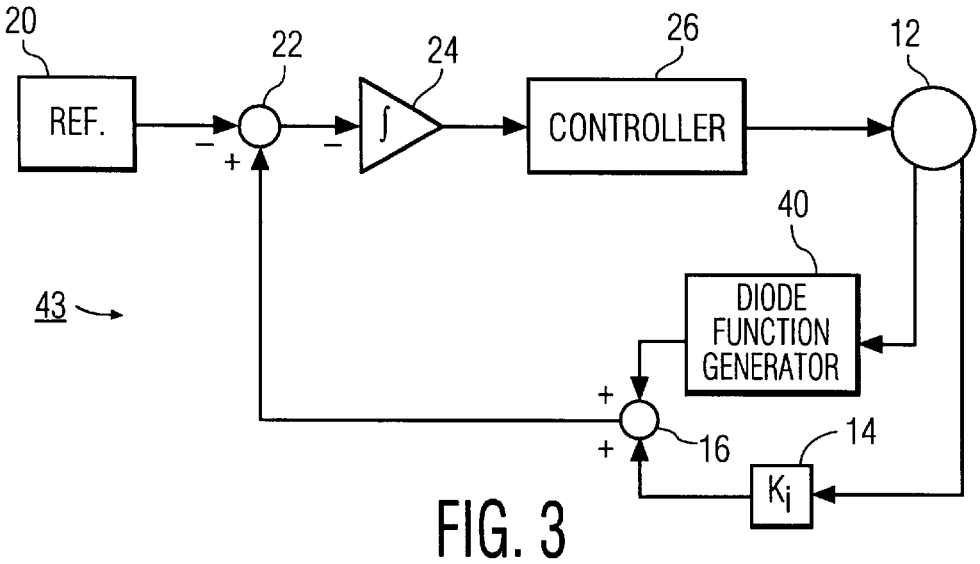
FIG. 3 is a block diagram of an inventive circuit for achieving nearly constant arc wattage.

In contrast to the prior art techniques, the technique of the present invention uses a voltage feedback signal first passed through a function generator to a summing node, instead of simply being scaled as in the prior technique. As shown in FIG. 3, which uses the same reference numbers as in FIG. 1 for like parts, a function generator 40 in ballast circuit 43 receives a voltage feedback signal from the lamp, and passes a processed signal to the summing circuit 16. Ideally, the function inserted into the voltage feedback path, would be an inverted hyperbola branch (−1/x). The effect on the feedback control system of inserting the ideal function is explained as follows.

Assume that the arc voltage increases independently in equal steps. The steps appear at a decreasing rate of increase at the summing node 16 (FIG. 3), due to the inserted function. As the control system maintains a constant output from the summing node, the ampere steps that are required to satisfy the feedback loop are complimentary to the output of the function generator. Therefore, the height of the arc ampere steps must track a normal hyperbola. The arc amperes are thus forced to be inversely proportional to arc volts. The constant arc watts characteristic is an indirect result, explained as follows. If, in general, arc amperes are inversely proportional to arc volts, then the product of arc volts and arc amperes (i.e., arc watts) is constant.

Figure 4A:
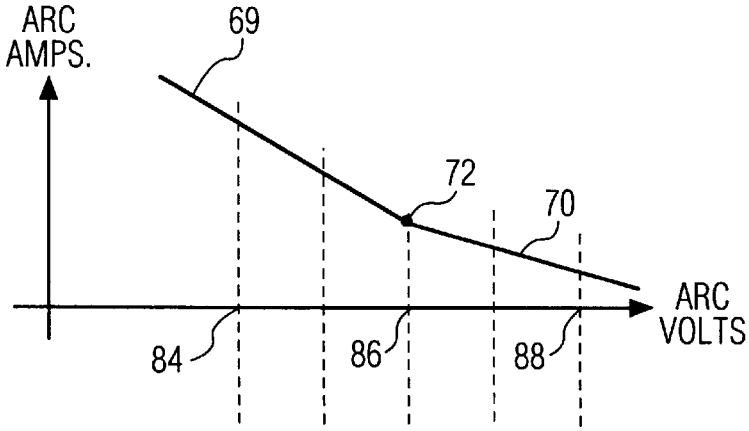
FIGS. 4A and 4B respectively show an arc amps-versus-arc volts characteristic, and arc watts-versus-arc volts characteristic, for the inventive circuit of FIG. 3.
Figure 4B:
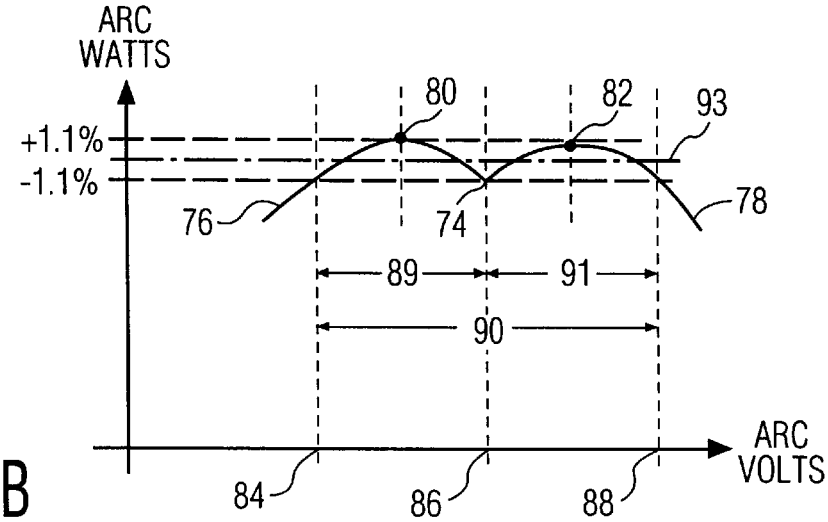
Figure 7:
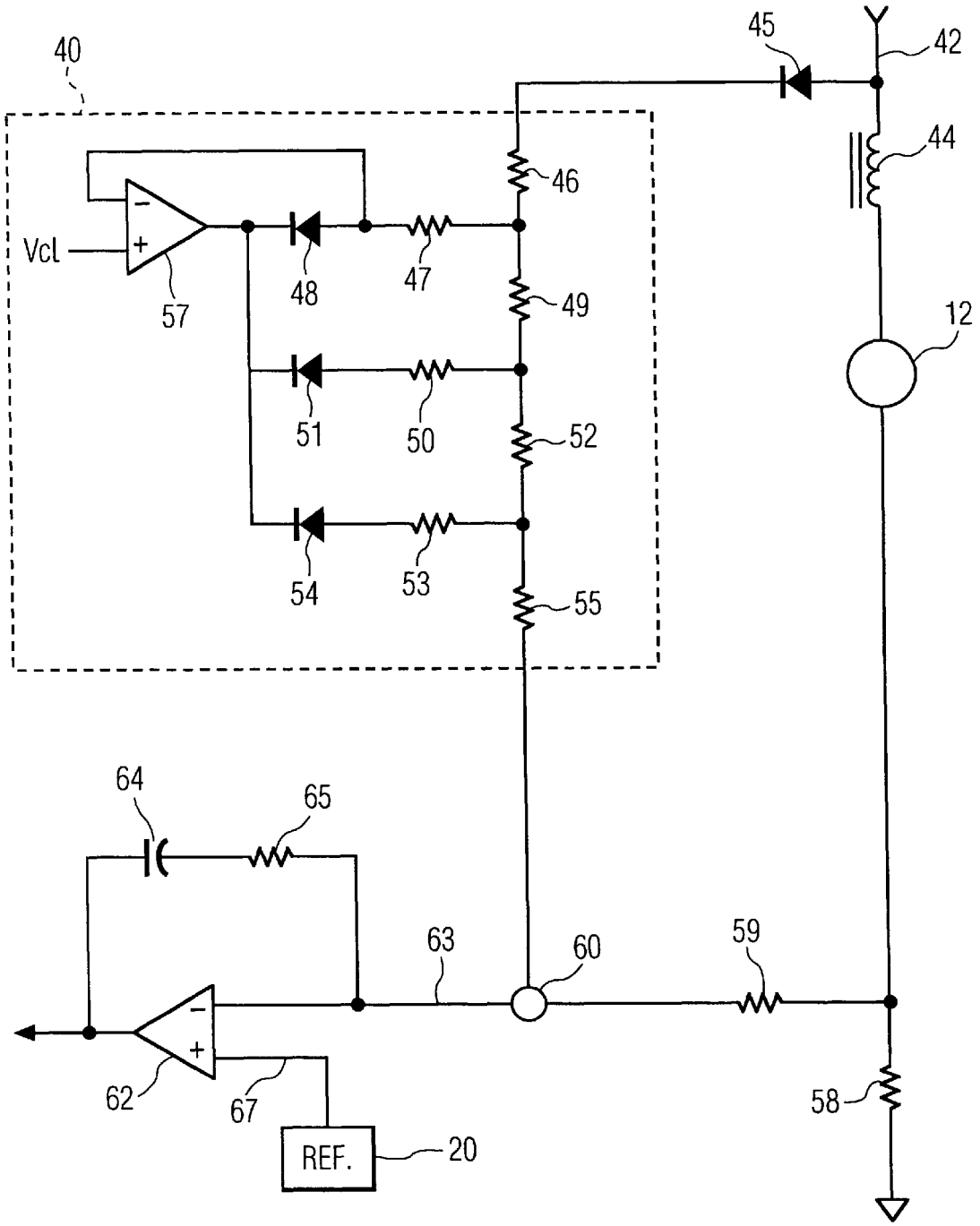
FIG. 7 is a schematic diagram, partially in block form, of the inventive ballast.

In the actual practice of the invention, the function inserted into the voltage feedback path is only a rough approximation to the ideal inverted hyperbola. The inserted function, generated by a diode function generator, gives rise in the arc amperes-versus-arc volts characteristic of joined line segments having uniformly decreasing positive slopes. The diode function generator 40 of FIG. 3 preferably comprises a diode-resistor ladder network. As shown in FIG. 7, each stage of the function generator 40, with the exception of the stage electrically furthest from the lamp comprises a series branch with a resistor (e.g., 46), and a shunt branch with a diode (e.g., 48) and a serially connected resistor (e.g., 47). The stage electrically furthest from the lamp comprises a series branch with a resistor 52, and a shunt branch comprising a diode 54 and an optional resistor 53. The diodes are all reverse biased at zero arc volts by a fixed circuit voltage. The diodes conduct one-by-one above predetermined arc voltages. As a diode becomes forward biased and switches in the corresponding resistor, the attenuation factor of the ladder increases and another segment (e.g., 69 or 70, FIG. 4A) of the function is formed. Each segment gives rise in the arc watts-versus-arc volts characteristic of a separate parabola section. Referring to FIGS. 4A and 4B, the slope break points (e.g., 72, FIG. 4A) in the amperes-versus-volts function correspond to cusps (e.g., 74, FIG. 4B) at the intersections of parabola sections (e.g., 76 and 78, FIG. 4B) in the watts-versus-volts characteristic. FIG. 4B shows vertices 80 and 82, as well as respective minimum, geometric mean and maximum arc operating voltages 84, 86 and 88. The operating voltage band for the lamp is shown at 90. The function generator line segments 69 and 70 are selected to track an inverted hyperbola as closely as possible and generate parabola sections 76 and 78 having equal watts variances.

With further reference to FIGS. 4A and 4B, the present invention solves the problem presented in the above example in a way that preserves the mentioned benefits of the prior art summing technique. The invented technique partitions the specified arc voltage range into two or more smaller, adjacent bands (e.g., 89 and 91). Each band has its own parabola (e.g., 76 and 78). The parabola curvature variance is reduced because the width of the (repeated) parabola is reduced from the original. In the example above, the specified (±) 30% voltage band 90 could be partitioned into two bands 89 and 91, each approximately (±) 15%, reducing the variance from nominal watts (shown at 93 in FIG. 4B) to 1.1% from 4.7% (Table I), leaving 3.9% variance for circuit tolerances, since 5% total variance is permitted by the specification. The ballast can now be built with low cost, 1% tolerance components without production trimming.

As the foregoing example shows, reducing the width of the parabola by 50% results in much more than a 50% reduction in the variance watts. This magnified, beneficial effect is the result of the square law relationship of the variables in the parabola function. There is no practical reason to reduce the watts variance below 0.5% so that, there is no real need to have parabolas with voltage band widths less than (±) 10% (Table I). In practice, this means that the number of parabolas rarely needs to exceed two in the operating voltage band. This is an important practical benefit resulting in only a small number of additional electrical components compared to the prior art summing technique.

Figure 5A:
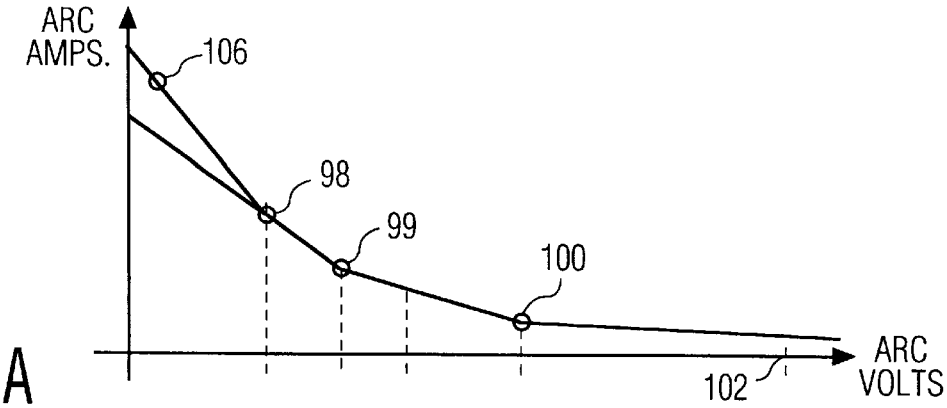
FIGS. 5A and 5B are similar to FIGS. 4A and 4B but additionally show operation of the lamp during warm-up and during high voltage operation.
Figure 5B:
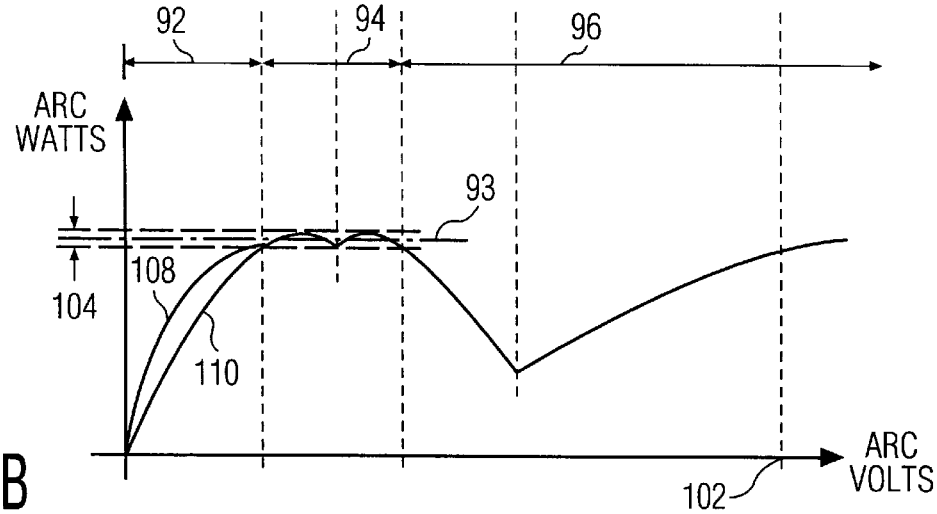

With reference to FIGS. 5A and 5B, it is convenient to separate the (entire) arc voltage range into the following three major bands 92, 94 and 96.

1. The warm up band 92. The arc passes through this band during warm up of a cold lamp. When a cold lamp is started, the arc voltage will bottom out (i.e., pass through a minimum) within the first few seconds. Typically, this minimum voltage is in the range, 13–24 volts. The arc voltage rises as the lamp warms up. The warm up band is the band of arc voltages from such minimum voltage to the lower edge of the normal operating voltage range.

2. The operating voltage band 94. The warmed up lamp remains in this band. FIG. 5B shows at 104 the operating watts variance (in dashed lines) about a nominal watts rating.

3. The high voltage band 96. The band of arc voltage above the operating voltage band is the high voltage band, and includes the ballast open circuit voltage 102. The arc passes through this band during ignition.

The design procedure for the function generator begins by applying Equation 1 above to determine how many segments are needed for just the operating voltage band. If the allowable variances can be met with one parabola, then the operating voltage band 94 needs only one segment. If two parabolas are needed, then one breakpoint should be placed at the geometric mean of the upper and lower operating band edge voltages. In general, the number of breakpoints is one less than the number of parabolas. The following characteristics are common to an optimized operating voltage band:

1. Has the minimum number of segments with absolute minimum variance (in watts) possible and meets the specification requirements.

2. The parabolas all have the same percent widths, measured by taking the voltage difference between two cusps (where the parabolas are joined) and dividing by the vertex voltage (of the same parabola).

3. The vertex of (any) parabola has a voltage coordinate at the arithmetic mean of the voltages at the two adjacent cusps.

4. The progression of breakpoint voltages forms a geometric series.

5. The watts at the vertices of the parabolas are all equal maxima for the band.

6. The watts at the cusps are all equal minima for the band.

The warm up band 92 is designed next. If no specification exists for this band, then nothing needs to be done. If a warm up point 106 in this band is specified, then a breakpoint (E.G., 98) is placed at the lower edge of the operating voltage band. At start up of a cold lamp, the arc voltage is minimum and the arc current is maximum. With a warm up point 106 specified and designed for, the current as shown in FIG. 5A will fall along a linear path that includes the warm up point, and the arc watts will follow a path as shown at 108 in FIG. 5B rather than 110. The time that it takes for a lamp to warm up reduces as the warm up point is raised in power. If no warm up point 106 is designed for, then the warm up current in FIG. 5A will follow the extension of the first line segment of the operating band, the arc watts will follow path 110 in FIG. 5B, and the warm up will be slow. Of course, the low voltage band could always be treated by design as just another operating band with its own set of specifications. This is true for any band of arc voltages in general.

Finally, the high voltage band 96 is designed. At least one breakpoint is needed in this band to prevent the arc current-versus-arc voltage function from intercepting zero amperes somewhere below the open circuit voltage 102. A good practice is to place a single breakpoint and a function segment somewhere in this band such that the arc current remains above zero and the arc watts remain below that specified for the operating voltage range.

Figure 6:
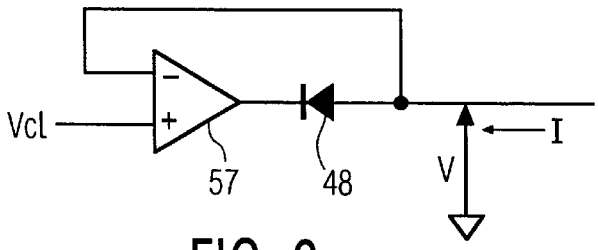
FIG. 6 is a schematic diagram of a precision diode circuit that may be used in the invention.
Figure 8:
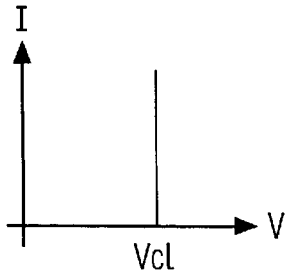
FIG. 8 is an ideal diode volt-ampere characteristic.

Typically, two or three breakpoints are all that are needed for the entire function. Each breakpoint requires a separate physical stage in the structure of the ladder network function generator. Each stage consists of a series resistor and a shunt branch having a resistor and diode connected in series. In a simplified form of the function generator, the cathodes of the diodes are connected directly to a fixed voltage source (i.e., clamp voltage). Diode conduction begins when a diode anode voltage exceeds the clamp voltage, ignoring the diode drop. The inventor used a "precision diode" operational amplifier ("opamp") circuit, shown in FIG. 6, which, by itself, is well known. In the precision diode implementation, the exponential (current-versus-voltage) function of the real diode is replaced by an ideal diode characteristic. That is, conduction begins with zero impedance when the anode of the real diode exactly equals the clamp voltage Vcl. The forward voltage drop of the real diode is canceled, along with the attendant temperature and current dependency, by the opamp output voltage, as a result of negative feedback around the opamp.

The first function generator designed by the inventor had the precision diode circuit repeated for each of the breakpoints. The ballast was tested and worked exactly as predicted. Then, all but one of the opamps were removed, leaving only the first precision diode circuit intact, for the lowest breakpoint voltage. The cathodes of the disconnected diodes were connected to the output of the remaining opamp. When the remaining, fully intact, precision diode circuit is conducting current above the first breakpoint voltage, the opamp output voltage, Vo, is regulated by the opamp circuit to be below the clamp voltage, Vcl, by an amount equal to the voltage drop of diode 48 (FIG. 7) designated V48 but not shown in the drawing. As a result, Vo=Vcl−V48. The anode voltage designated AV51 but not shown in the drawing of a conducting, reconnected diode 51 (FIG. 7) is a diode drop V51 (not shown) above the output voltage of the opamp. As a result, AV51=Vo+V51=(Vcl−V48)+V51.

As the foregoing formula shows, the two diode voltage drops, V48 and V51, have opposing signs, making the anode voltage AV51 of diode 51 nearly equal to the clamp voltage, Vcl, when the two diode currents are the same order of magnitude, which occurs when operation is sufficiently above the diode 51 breakpoint. Diode 51 starts to conduct below the corresponding breakpoint because its cathode voltage is held a fill diode drop below the clamp voltage by the opamp. More precisely, when diode 51 begins to conduct, V51 is less than V48, so that the anode voltage AV51 of diode 51 is less than the clamp voltage Vcl. The breakpoint, on the other hand, corresponds to the anode voltage being equal to the clamp voltage; that is, AV51=Vcl at the breakpoint. The earlier onset of diode conduction along with the continuously decreasing diode impedance with increasing diode current, effectively spreads the breakpoint out over a band of voltages. Beneficially, the cusps soften into rounded valleys that face concave upwards. As a result, the peak-to-peak ripple in the arc watts function is reduced. In summary, the single opamp "idealizes" the diode corresponding to the lowest breakpoint, thereby removing the temperature dependency of the diode. Furthermore, the temperature effects of the other diodes are partially compensated for, because they are, in effect, connected in series opposition with the real diode of the precision diode opamp circuit.

In addition to a schematic diagram for function generator 40 discussed above, FIG. 7 shows an output 42 from controller 26 of FIG. 3, an ignitor coil 44 and a cooperating diode 45. It also shows a current sense resistor 58, a summing resistor 59, a summing node 60, an opamp 62 with a capacitor 64 and resistor 65 in a feedback loop, and a circuit 20 providing a reference voltage on an input to the opamp. The output of the opamp goes to controller 26 (FIG. 3).

The following example demonstrates an exemplary procedure for determining the function generator circuit values. For convenience, various designations such as "R59" instead of "resistor 59" will be used in this discussion, although such designations do not appear in the drawings. The design requirements are as follows.

Nominal operating arc watts: 70 W (±) 2.5%.

Operating arc voltage range: 52–77 volts.

Warm up point (106, FIG. 5A): 15 V, 2.5 A.

Ballast open circuit voltage (OCV=400 v).

Maximum ballast voltage possible at 70 W=200 V.

Current sense resistor (58, FIG. 7), renamed R58 for this discussion, is initially chosen for low power dissipation. R58=0.332 (1%) ohms. Resistor 59, renamed R59, is initially chosen to obviate the error effect due to opamp bias current in line 63 (FIG. 7). R59=1.02 k (1%) ohms. Clamp voltage (FIG. 7), Vcl=7.5 V. The winding resistance of the ignitor coil 44, named Rc=0.6 ohms.

For convenience, the following steps are numbered.

1. Solve for the mean operating arc voltage: (52+77)/2=64.5 V.

2. Solve for the decimal value of (±) % volts range: Kv=(77−52)/(2×64.5)=0.1938.

3. Solve for the decimal value of (±) % watts variance using Eq. 1: $Kw=Kv^2/(2-Kv^2)=0.1938^2/(2-0.1939^2)=0.019=1.9\%$.

As shown above, the watts variance due to parabola curvature is 1.9% (assuming a single parabola) leaving only 0.6% for circuit tolerances. Therefore, choose a two parabola design by inserting a breakpoint at the geometric mean operating arc voltage.

4. Solve for the geometric mean voltage: $Vgm=(77\times52)^{1/2}=63.277$ V.

5. Solve for the arithmetic mean voltage at the vertex of the lower voltage parabola: (52+63.277)/2=57.64 V.=(vertex voltage of the lower voltage parabola).

6. Solve for the arithmetic mean voltage at the vertex of the higher voltage parabola: (63.277+77)/2=70.14 V.=(vertex voltage of the higher voltage parabola).

7. Solve for the new decimal value of (±) % volts range for the lower voltage parabola: Kv=(63.277+52)/(2×57.64)=0.0978. As a check, solve for the Kv of the higher voltage parabola (should be the same). Kv=(77−63.277)/(2×70.14)=0.0978. (checks).

8. Solve for the new decimal value of (±) % watts variance using Equation 1 again. $Kw=Kv^2/(2-Kv^2)=0.0978^2/(2-0.0978^2)=0.005=0.5\%$. The watts variance due to parabola curvature is now only (±) 0.5% leaving 2% for circuit tolerances. The circuit can now be built using low cost 1% components without the need for trimming.

9. Power at the first breakpoint is 0.5% below 70 W=69.65 W.

10. Current at the first breakpoint is Ibp1=69.65 W/52 V=1.339 A.

11. Solve for the slope, m1, of the first line segment using the known coordinates of the warm-up point and first breakpoint, m1=(1.339−2.5)/(52−15)=−0.0313669 A/V.

12. Rt is defined as the sum of resistors 46, 49, 52, and 55 (FIG. 7) as given below. Rt=R46+R49+R52+R55. Solve for Rt using the following formula derived by the present inventor. Rt=R59/R58(−1/m1−Rc)−R59+R58. Rt=1020/0.332(1/0.0313669−0.6)−1020+0.332=95.1 k ohms.

The reference voltage Vref (67, FIG. 7) is calculated next by assuming the lamp voltage to be at the first breakpoint (52 V) just before any current flows in the shunt resistor 47. That way, the voltage at summing node 60 can easily be calculated and Vref set equal to it.

Note 1: Assume that the opamp bias current flowing in line 63 is very small compared to the current in Rt. This assumption must be validated in a following calculation. With these assumptions on lamp voltage and opamp bias current, calculate the current Irt in Rt by summing the voltages around the loop that includes the lamp and Rt as follows.

13. Irt=(Vbp1+Ibp1×Rc−0.6)/(Rt+R59).

Note 2: The 0.6 in the above formula is the assumed voltage drop across diode 45. Irt=(52+1.339×0.6−0.6)/(95,084+1020)=0.5432 mA.

14. The voltage at the summing node 60, assumed to be equal to Vref, is found by summing the voltage drops across R59 and R58: Vref=Irt×R59+(Ibp1+Irt)×R58

Vref=0.5432×1.02+(1.339+0.0005432)×0.332=0.999 V.

Note 3: The opamp bias current is less than 1 microampere which is negligible in comparison to the current Irt so the above assumption in note 1 is validated.

15. The resistor 46 (FIG. 7) renamed R46 is solved for next. Split Rt into two series connected resistors, R46+(R49+R52+R55) such that the voltage at the bottom of R46 is equal to Vcl when the lamp voltage is equal to the first breakpoint voltage. Then solve for (R49+R52+R55).

(R49+R52+R55)=(Vcl−Vref)/Irt.

(R49+R52+R55)=(7.5−0.999)/0.5432 mA=12.0 k Ohms.

R46=Rt−(R49+R52+R55).

R46=95.1 k−12.0 k=83.1 k.

R47 and R49 are solved for by assuming the lamp voltage to be equal to the second breakpoint (99, FIG. 5A) voltage, 63.277 V, making the voltage at the junction of resistors 49 and 52 equal to the clamp voltage (7.5 V). With these assumptions, first solve for the current at the second breakpoint, Ibp2.

16. Ibp2=0.995×70 W/63.277 V=1.10 A.

17. Next, solve for the current, Ir2, in R52, R55.

Ir2=(Vref−Ibp2×R58)/(R59+R58).

Ir2=(0.999−1.1×0.332)/(1020+0.332)=0.621 mA.

18. Solve for the sum of resistors 52 and 55.

(R52+R55)=(Vcl−Vref)/Ir2.

(R52+R55)=(7.5−0.999)/0.6218 mA=10.5 k Ohms.

19. Solve for resistor 49, renamed R49.

R49=(R49+R52+R55)−(R52+R55).

R49=12.0 k−10.5 k=1.5 k.

20. Solve for the voltage at the top of resistor 49, Vt49, assuming the voltage at the bottom of resistor 49 equals the clamp voltage, Vcl.

Vt49=Vcl+Ir2×R49.

Vt49=7.5+0.621×1.5=8.43 V.

21. Solve for the voltage at the top of resistor 46, Vt46.

Vt46=Vbp2+Ibp2×(Rc+R58)+Ir2×R58−0.6.

Vt46=63.277+1.10×(0.6+0.332)+0.000621×0.332−0.6=63.7 V.

22. Solve for the voltage across resistor 46=63.7−8.43=55.27.

23. Solve for the current in resistor 46=55.27/83.1 k=0.665 mA.

24. Solve for the current in resistor 47=0.665 mA−0.621 mA=0.044 mA.

25. Solve for R47=(8.43−7.5)/0.044 mA=21.1 k ohms.

Assume that the lamp voltage is set to the maximum operating band voltage (77 V, not a breakpoint, see FIG. 5A and 5B).

26. Solve for the lamp current, Imo, at the maximum operating band voltage. Imo=0.995×70 W/77 V=0.90455 A.

27. Solve for the current, Ir3, in resistors 52 and 55.

Ir3=(Vref−Imo×R58)/(R59+R58).

Ir3=(0.999−0.90455×0.332)/(1.02 k+0.000332 k)=0.685 mA.

28. Solve for the voltage, V52, at the top of R52.

V52=Vref+Ir3×(R52+R55).

V52=0.999+0.685×10.5=8.19 V.

29. Solve for the current, I50, in resistor 50. First, express the voltage, V49, at the top of R49 in terms of I50.

30. V49=V52+(I50+Ir3)×R49.

V49=8.19+(I50+0.685mA)×1.5 k.

V49=9.2175+1.5 k×I50.

31. Solve for the current, I49, in R49.

I49=(V49−V52)/R49=(V49−8.19)/1.5 k.

I49=(9.2175+1.5 k×I50−8.19)/1.5 k.

I49=0.685 mA+I50.

32. Solve for the current, I47, in resistor 47.

I47=(V49−Vcl)/R47=(9.2175+1.5 k×I50−7.5)/21.1 k.

I47=0.0814 mA+0.07109×I50.

33. Solve for the current, I46, in resistor 46.

I46=I47+I49.

I46=(0.0814 mA+0.07109×I50)+(0.685 mA+I50).

I46=0.7664 mA+1.07109×I50.

34. Solve for the voltage, V46, at the top of resistor 46.

V46=V49+I46×R46.

V46=V49+(0.7664 mA+1.07109×I50)×83.1 k.

V46=V49+63.6878+89.01 k×I50.

V46=(9.2175+1.5 k×I50)+63.6878+89.01 k×I50.

V46=72.9053+90.51 k×I50.

35. Now solve for V46 in terms of the known lamp voltage (77 V).

V46=(Imo+Ir3)×R58+77+Imo×Rc−0.6.

V46=(0.90455+0.685)×0.332+77+0.90455×0.6−0.6.

V46=77.47 V.

36. Set the two expressions for V46 (from 32 and 33) equal to each other and solve for I50.

72.9053+90.51 k×I50=77.47.

I50=(77.47−72.9053)/90.51 k.

I50=0.050433 mA.

37. Solve for the resistance of 50.

R50=(V52−Vcl)/I50.

R50=(8.19−7.5)/0.050433 mA=13.7 k.

38. The final breakpoint (100, FIG. 5B) is in the high voltage band. The purpose of this breakpoint is to prevent the current from intercepting the zero axis. Solve for the slope, m3, of the third line segment (arc amps Vs arc volts), passing through the upper limit of the operating voltage band, using the known coordinates of two points that lie on the segment. The two points are:

Vgm, Ibp2=63.277 V, 1.10 A at the geometric mean voltage (99, FIG. 5A), and, 77 V, Imo=77 V, 0.90455 at the upper edge of the operating voltage band.

m3=(0.90455−1.10)/(77−63.277)=−0.01424 A/V.

The line segment intercepts zero amperes when the current drops 0.90455 A starting from the operating band edge point (77 V, 0.90455 A). The voltage at the zero current point is 77+0.90455/0.01424=141 V. Since the open circuit voltage of the ballast is 400 V, the breakpoint must be placed somewhere between 77V and 141 V. A good idea is to set the breakpoint at a current of 0.35 A for this example. Then, assuming a flat slope for the final line segment, the power will be 70 W at 200 V (e.g., 0.35 A×200 V=70 W). Recall that the maximum power at 200 V that the ballast can deliver was given to be 70 W. Place the breakpoint at 0.35 A.

Ibp3=0.35 A The corresponding voltage is:

Vbp3=77+(Imo−Ibp3)/m3=77+(0.90455−0.35)/0.01424=116 V.

The watts at this final breakpoint is,

Pbp3=116×0.35=40.6 W.

The parabola characteristic (FIG. 5B) will result in a continuous drop in watts above the operating band until the final breakpoint (100, FIG. 5B) is reached at 116 V where the watts will be at a local minimum (40.6 W). Beyond 116 V, the watts characteristic rises until reaching 70 W at 200 V as planned. Assume that the arc voltage is at Bp3 and the voltage at the top of resistor 55 is equal to Vcl.

39. Solve for the current, Ir4, in resistors 52 and 55.

Ir4=(Vref−Ibp3×R58)/(R59+R58).

Ir4=0.999−0.35×0.332)/(1.02 k+0.000332 k)=0.8652 mA.

40. Solve for R55=(Vcl−Vref)/Ir4.

R55=(7.5−0.999)/0.8652 mA=7.51 k Ohms.

41. Solve for R52=(R52+R55)−R55.

R52=10.5 k−7.51 k=2.99 k Ohms.

R53 for this example is zero ohms, producing a zero slope for the final line segment as planned above.

The inventive circuit described herein has been repeatedly built and tested dozens of times, and has performed flawlessly without the need for circuit trimming.

While the invention has been described with respect to specific embodiments by way of illustration, many modifications and changes will occur to those skilled in the art. It is therefore, to be understood that the appended claims are intended to cover all such modifications and changes as fall within the true spirit and scope of the invention.

What is claimed is:

1. A constant wattage electronic ballast circuit for a lamp, comprising:

(a) a circuit for producing a voltage feedback signal substantially proportional to voltage of the lamp;

(b) a diode function generator for processing said voltage feedback signal so as to produce a processed signal which, within sequential bands of lamp voltage, varies less for a specified variation of lamp voltage in a higher voltage band than in a lower voltage band;

(c) a circuit for producing a current feedback signal substantially proportional to current in the lamp; and (d) a circuit for controlling lamp current, said circuit comprising:

(i) a circuit for summing said processed signal with said current feedback signal to create a summed signal; and (ii) a circuit for adjusting lamp current in response to the difference between said summed signal and a reference signal.

2. The ballast circuit of claim 1, wherein said diode function generator comprises a ladder network.

3. The ballast circuit of claim 2, wherein:

(a) each stage of said ladder network with the exception of a stage electrically furthest from said lamp, comprises:

(i) a series branch comprising a resistance connected between respective first and second nodes; and (ii) a shunt branch comprising a diode and a serially connected resistance, collectively connected between the second node and a reference voltage node; the foregoing diode turning on when the voltage at the second node reaches a threshold level; and (b) the stage electrically furthest from said lamp comprises:

(i) a series branch comprising a resistance connected between respective first and second nodes; and (ii) a shunt branch comprising a diode connected between the second node and a reference voltage node; the foregoing diode turning on when the voltage at the second node reaches a threshold level.

4. The ballast circuit of claim 3, wherein the cathodes of the diodes of each stage of said ladder network are interconnected.

5. The ballast circuit of claim 3, further including a single precision diode circuit, said precision diode circuit being associated with the diode of the stage of said ladder network electrically nearest to said lamp.

6. The ballast circuit of claim 5, wherein said precision diode circuit comprises an opamp with an output connected to the cathode of its associated diode, an input connected to receive a reference voltage, and an input connected to the anode of the associated diode.

7. The ballast circuit of claim 6, wherein the cathodes of each diode of said ladder network are all connected to said output of said opamp.

8. A constant wattage electronic ballast circuit for a high pressure discharge lamp, comprising:

(a) a circuit for producing a voltage feedback signal substantially proportional to voltage of the lamp;

(b) a diode function generator for processing said voltage feedback signal so as to produce a processed signal which, within sequential bands of lamp voltage, varies less for a specified variation of lamp voltage in a higher voltage band than in a lower voltage band;

(c) a circuit for producing a current feedback signal substantially proportional to current in the lamp; and (d) a circuit for controlling lamp current, said circuit comprising:

(i) a circuit for summing said processed signal with said current feedback signal to create a summed signal; and (ii) a circuit for adjusting lamp current in response to the difference between said summed signal and a reference signal.

9. The ballast circuit of claim 8, wherein the lamp comprises a metal halide lamp.

10. The ballast circuit of claim 8, wherein said diode function generator comprises a ladder network.

11. The ballast circuit of claim 10, wherein:

(a) each stage of said ladder network with the exception of a stage electrically furthest from said lamp, comprises:

(i) a series branch comprising a resistance connected between respective first and second nodes; and (ii) a shunt branch comprising a diode and a serially connected resistance, collectively connected between the second node and a reference voltage node; the foregoing diode turning on when the voltage at the second node reaches a threshold level; and (b) the stage electrically furthest from said lamp comprises:

(i) a series branch comprising a resistance connected between respective first and second nodes; and (ii) a shunt branch comprising a diode connected between the second node and a reference voltage node; the foregoing diode turning on when the voltage at the second node reaches a threshold level.

12. The ballast circuit of claim 11, wherein the cathodes of the diodes of each stage of said ladder network are interconnected.

13. The ballast circuit of claim 11, further including a single precision diode circuit, said precision diode circuit being associated with the diode of the stage of said ladder network electrically nearest to said lamp.

14. The ballast circuit of claim 13, wherein said precision diode circuit comprises an opamp with an output connected to the cathode of its associated diode, an input connected to receive a reference voltage, and an input connected to the anode of the associated diode.

15. The ballast circuit of claim 14, wherein the cathodes of each diode of said ladder network are all connected to said output of said opamp.

* * * * *